United States Patent [19]

Marforio

[11] 4,040,370

[45] Aug. 9, 1977

[54] STITCH CONTROL DEVICE FOR SEWING MACHINES

[75] Inventor: Nerino Marforio, Milan, Italy

[73] Assignee: Rockwell-Rimoldi S.p.A., Milan, Italy

[21] Appl. No.: 727,886

[22] Filed: Sept. 29, 1976

[30] Foreign Application Priority Data

Oct. 2, 1975 Italy ..... 27872/75

[51] Int. Cl.[2] ..... D05B 65/00; D05B 53/00

[52] U.S. Cl. ..... 112/299; 112/253; 112/302

[58] Field of Search ..... 112/252, 253, 235, 151

[56] References Cited

U.S. PATENT DOCUMENTS

| | | | |
|---|---|---|---|
| 184,950 | 12/1876 | Bayley | 112/253 X |
| 525,042 | 8/1894 | Borton | 112/151 |
| 3,379,151 | 4/1968 | Tiemann | 112/252 |
| 3,698,336 | 10/1972 | Launer | 112/252 |

FOREIGN PATENT DOCUMENTS

| | | | |
|---|---|---|---|
| 311,184 | 2/1919 | Germany | 112/253 |

*Primary Examiner*—H. Hampton Hunter

[57] ABSTRACT

A device carried by the presser foot of a sewing machine for severing a chain of stitches extending between a sewn workpiece and the needle of the machine which includes a gripping element for retaining the severed end of the chain extending from the needle and a guide means for aligning the chain with the needle axis in a manner whereby it would be incorporated into the seam of stitches formed in the following workpiece.

7 Claims, 3 Drawing Figures

STITCH CONTROL DEVICE FOR SEWING MACHINES

BACKGROUND OF THE INVENTION

The present invention pertains to a straight sewing machine and more particularly to a device for such machines for retaining the free end of a chain of stitches until the beginning of a new seam so as to incorporate the free end of the chain into the new seam. A device for retaining a chain of stitches at the beginning of the seam is well known in the case of sewing machines adapted to produce a zig-zag or overcasting stitch and hence in machines in which the stitches are formed transversely with respect to the sewing axis.

In these types of machines the chain of stitches is readily incorporated in the succeeding seam without precise alignment with the sewing axis for the width of the seam is substantially wider than that of the chain. Additionally in these types of machines the chain is located close to the workpiece support surface and is thus incorporated in the stitching beneath the workpiece per se. In the case in point, i.e., of a straight sewing machine in which the chain must be incorporated in a seam having the same dimensions as the chain, the arrangement employed on zig-zag or overcasting machines cannot be utilized for it is not possible to provide positive alignment of the chain with the needle since it is covered by the workpiece and cannot be controlled when it is released from the chain retention device.

An object of the present invention is that of providing a device for the positive control of the chain of stitches at the beginning of a seam in straight sewing machines so as to incorporate the chain into said seam.

To attain this object, the technical problem which the present invention is adapted to solve is that of retaining a chain of stitches in such a way that it intersects the needle axis, and of maintaining it in this position along its entire length so that it is completely incorporated in the stitching being formed.

SUMMARY OF THE INVENTION

According to the present invention, the above technical problem is solved by means of a sewing machine equipped with a device for retaining the chain of stitches. The device forms an integral part of the sewing machine's presser foot which includes a guide groove extending between the needle aperture and the leading end of the sole per se. The longitudinal axis of the guide groove intersects the needle axis and the chain retention device is located forwardly of the needle and adjacent the opening of a slot located in the leading end of the sole. With the various elements of the device being carried by the presser foot said device moves with said presser foot during the performance of its intended function.

Another object of the invention is to provide a presser foot for a sewing machine as defined above in which the presser foot carries a chain retention device located on the forward portion of the sole and adjacent the mouth of the guide groove.

These and other features will be made apparent in the following detailed description of a preferred but not exclusive embodiment of the invention provided by way of example only with reference to the accompanying drawings, in which:

DESCRIPTION OF THE PREFERRED EMBODIMENT

Figure 1:
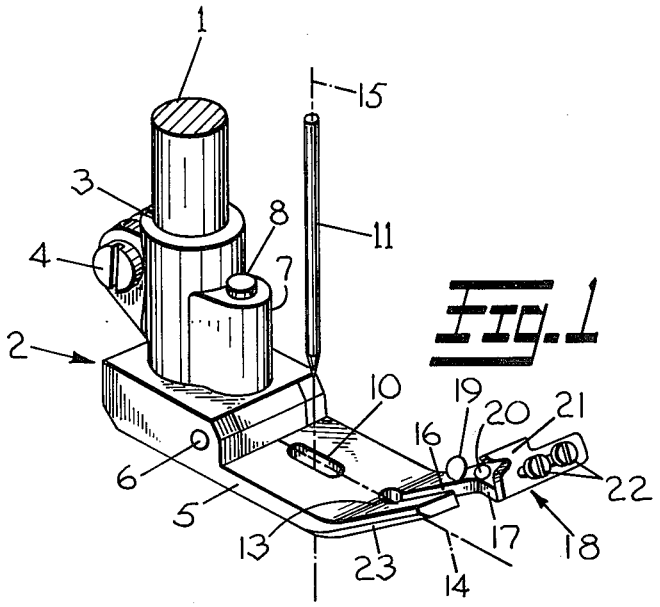
FIG. 1 is a perspective view of a presser foot of a sewing machine equipped with the device according to the invention for retaining a chain of stitches.
Figure 2:
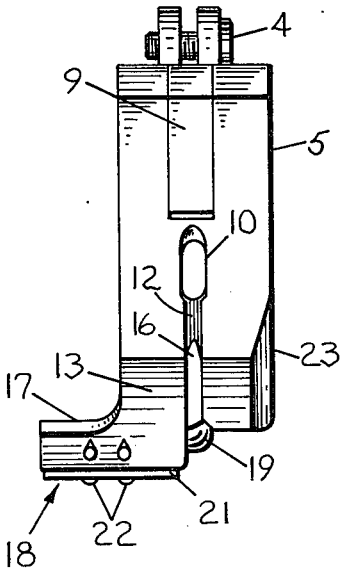
FIG. 2 is a bottom view of the presser foot shown in FIG. 1.

Referring now to FIG. 1, a presser bar 1 of a conventional sewing machine is shown and includes a presser foot 2 that is attached to said presser bar by means of a clamp 3 provided with a tightening screw 4. The sole of the presser foot is identified by number 5 and is hinged to the clamp 3 by means of a pin 6. The clamp 3 includes an integral extension 7 that carries a screw 8 for supporting an auxiliary sole 9 in a conventional manner (FIG. 2). The sole 5 includes an aperture 10 through which a needle 11 passes so as to form stitches in cooperation with the conventional sewing elements (not shown).

As in shown in FIG. 2, the sole 5 is provided with a guide groove or channel 12 which extends between the aperture 10 and the forward end 13 of the sole in a manner whereby the longitudinal axis 14 thereof intersects the needle axis 15 (FIG. 1). The guide groove 12 is located in horizontally disposed portion of the sole 5 and adjacent to the groove, the leading surface 13 is bifurcated forming a slot 16 that is operatively associated with said groove. A chain retention device 18 is assembled on an integral projection 17 formed on the forward end 13 of the sole immediately adjacent to the open portion of the slot 16.

The device 18 includes a gripping member in the form of a leaf spring 19 attached by means of a screw 20 to the upper surface of projection 17 and a blade element 21 which is fixed by means of screws 22 to the leading end of said projection 17. The sole 5 includes a bevel portion 23 which forms the lower edge of the forward end 13 on the side opposite the device 18 so that a chain being drawn along this bevel portion will automatically enter into the slot 16. Upon completing a stitching operation on a workpiece, the operator takes the sewn workpiece which is caused to slide along the bevel 23 and the thread is then entered into the slot 16. Thereafter the chain is inserted by the operator beneath the leaf spring 19 which grips it and the remainder is then drawn towards the blade 21 so as to be cut. As a result the workpiece is separated from the chain and a section of chain remains between the needle and the spring 19 in a manner whereby said chain is located in the guide groove 12 and the slot 16 and in alignment with the longitudinal axis 14.

Figure 3:
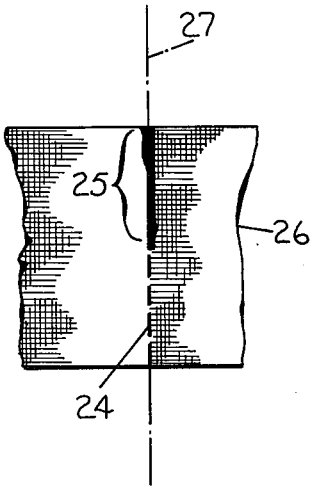
FIG. 3 shows a piece of fabric with a seam of straight stitching superposed on a chain of stitches.

The succeeding step, which is represented in FIG. 3 is that of forming the succeeding seam 24 on the workpiece 26 over the section of chain represented by 25 in FIG. 3 in such a way that the chain section 25 is incorporated into the seam 24.

This is achieved in that the workpiece 26 is disposed beneath the presser foot 2 and is advanced by conventional sewing instrumentalities and the chain section 25 is simultaneously released from the grip of the spring 19, leaving it compressed between the workpiece 26 and the groove 12. The guide groove 12 guides and keeps the chain section aligned with the axis 15 of the needle 11 such that the seam 24 is accurately formed over the chain section 25.

In the above-described embodiment the longitudinal axis 14 of the guide groove is coincident with the sewing axis 27 (FIG. 3). However, the groove 12 could be oriented in a different direction without departing from the scope of the present invention.

Although the present invention has been described in connection with a preferred embodiment, it is to be understood that modifications and variations may be resorted to without departing from the spirit and scope of the invention and the appended claims.

I claim:

1. A chain stitch control device for straight sewing machines of the type having a sewing needle disposed in operative association with a needle aperture provided in the machine presser foot, said chain stitch control device comprising:

a. a sole (5) forming the lower portion of the presser foot;

b. means on one end of said sole for receiving a chain of stitches extending between the needle and a sewn workpiece;

c. means interconnecting the needle aperture and said receiving means for aligning the chain of stitches received by the latter with the axis of the sewing needle;

d. gripping means attached to said sole for temporarily holding the chain of stitches received by said receiving means; and e. a cutting means fixed on said sole for severing the chain of stitches intermediate the gripping means a sewn workpiece to permit the sewing instrumentalities to incorporate the chain of stitches extending from the sewing needle into the seam formed in the next workpiece.

2. The chain stitch control device according to claim 1 wherein said receiving means includes a bifurcated forward end (13) on said sole (5) that defines a slot (16) into which the chain of stitches is receivable.

3. The chain stitch control device according to claim 2 wherein said bifurcated forward end (13) includes a bevel (23) formed on one side thereof to facilitate entry of the chain of stitches into said slot (16).

4. The chain stitch control device according to claim 2 wherein said bifurcated forward end (13) includes an integral projection (17) for attaching said gripping and cutting means to said sole (5).

5. The chain stitch control device according to claim 4 wherein said gripping means defines a leaf spring (19) fixed on the upper surface of said projection (17) in operative association with said slot (16).

6. The chain stitch control device according to claim 4 wherein said cutting means defines a blade element (21) fixed on the forward end of said projection (17) in operative association with said gripping means and said slot 16.

7. The chain stitch control device according to claim 1 wherein said aligning means defines a guide channel (12) formed in the lower surface of said sole (5).

* * * * *